US005707179A

United States Patent [19]

Bruckelmyer

[11] Patent Number: 5,707,179

[45] Date of Patent: Jan. 13, 1998

[54] METHOD AND APPARAATUS FOR CURING CONCRETE

[76] Inventor: Mark Bruckelmyer, 5617 Mc Quade Rd., Duluth, Minn. 55804

[21] Appl. No.: 619,034

[22] Filed: Mar. 20, 1996

[51] Int. Cl.[6] ..... E02D 5/00

[52] U.S. Cl. ..... 405/229; 165/45; 249/79; 264/333; 404/95; 405/131; 405/258

[58] Field of Search ..... 405/131, 130, 405/258, 229; 249/79; 52/309.12, 309.17, 309.09; 264/333, 31, 35; 165/45, 45 H; 404/95

[56] References Cited

U.S. PATENT DOCUMENTS

| | | | |
|---|---|---|---|
| 3,081,488 | 3/1963 | Casavina et al. | 249/79 X |
| 3,405,681 | 10/1968 | Backlund | 405/131 X |
| 3,626,149 | 12/1971 | Carney | 165/45 X |
| 3,782,132 | 1/1974 | Lohoff | 165/45 X |
| 3,856,254 | 12/1974 | Fattor | 249/79 X |
| 5,168,008 | 12/1992 | Yoshida et al. | 264/333 X |
| 5,178,485 | 1/1993 | Katsuragi et al. | 165/45 X |
| 5,233,971 | 8/1993 | Hanley | 165/45 X |

FOREIGN PATENT DOCUMENTS

| | | | |
|---|---|---|---|
| 401795 | 5/1966 | Switzerland | 249/79 |

*Primary Examiner*—Dennis L. Taylor

*Attorney, Agent, or Firm*—Palmatier, Sjoquist, Helget & Voigt, P.A.

[57] ABSTRACT

A method and apparatus for optimizing the curing of concrete poured under hostile ambient temperature conditions. The apparatus includes a liquid reservoir and pumping system and a number of spaced-apart tube segments overlaid into the forms for receiving the concrete with respective ends of the tubes positioned outside the concrete forms. A liquid manifold is connected to one set of tube ends and a second liquid manifold is connected to the other set of tube ends. The temperature of the liquid in the reservoir is adjusted for optimum curing of concrete, and the liquid is pumped through the tubes after the concrete has been poured; when the concrete hardens the liquid is disconnected, and the tubes are disconnected from the manifolds without removing the tubes from the hardened concrete.

16 Claims, 4 Drawing Sheets

METHOD AND APPARAATUS FOR CURING CONCRETE

BACKGROUND OF THE INVENTION

The present invention relates to a method and apparatus for curing concrete, particularly under conditions where the temperature is outside the range of normal concrete curing temperature. The invention is particularly useful in connection with outdoor construction projects in northern climates, especially during the winter months.

The present invention is related to my copending application Ser. No. 08/504,526, filed Jul. 20, 1995, and entitled "METHOD FOR THAWING FROZEN GROUND FOR LAYING CONCRETE" now U.S. Pat. No. 5,567,085. The related application focuses on a method for preparing a frozen ground surface for laying concrete, whereas the present invention relates specifically to the curing of the concrete.

For optimum results in curing freshly laid concrete, it is desirable that the concrete be laid at an ambient temperature in the range of 50° F.–80° F. The chemical reaction which occurs during the time that concrete is curing generates heat, called the heat of hydration, and the heat generation process contributes to the quality and strength of the finished concrete product. The release of the heat of hydration contributes to the concrete curing process, and the release generally does not commence until about six hours after the concrete has been poured, and the bulk of the hydration heat is released after about 24 hours under optimal ambient temperature conditions. The rate of heat evolution generally ranges between about two and ten calories per gram per hour, and the concrete gradually gains strength during the entire process. After about 6–7 hours under optimal ambient temperature conditions concrete will achieve a load strength of 2000 pounds per square inch (lbs/in$^2$), and the load strength gradually increases to a maximum level sometime after 48 hours. It is usually possible to begin applying load members to concrete under these conditions after about six to eight hours, although additional curing time is obviously desirable.

As the ambient temperature decreases the rate at which concrete gains strength during the curing time slows considerably. For example, if the strength is compared to concrete poured at an optimal temperature of 65° F. after 24 hours, it is known that concrete poured at the freezing point will achieve only 75% of the strength under optimal conditions, and concrete poured at 20° F. will achieve less than 30% of the strength under optimal conditions. Therefore, the net effect of pouring concrete under ambient temperatures below about 65° F. is to delay the time when the finished concrete may be used, or to delay the time before further loading may be applied to the concrete. In construction projects this means that further construction cannot be applied to the concrete until more complete curing has occurred.

In an effort to better control the ambient temperature during outdoor concrete curing processes, it is frequently necessary to attempt to enclose the work site in a temporary construction, such as a lightweight frame covered with plastic sheeting. Under severe ambient temperature conditions, there is usually an attempt to add heat to the interior of this temporary construction to thereby warm the concrete and enhance the curing process in order to improve the overall strength of the concrete after curing. The cost of the temporary shelter, as well as the cost to maintain heat within the temporary shelter, represent a significant additional construction cost when laying concrete under low temperature conditions.

Under high ambient temperature conditions a further problem occurs, which can lead to an overall loss of strength in the cured concrete. If concrete is poured under ambient temperature conditions exceeding about 85° F. a noticeable loss of strength will occur unless steps are taken to control the temperature of the concrete. For example, concrete poured at 65° F. will normally achieve a safe strength for supporting further construction after 24 hours, whereas concrete poured at 100° F. will achieve only about ½ this strength after 24 hours, and will probably never achieve more than about ½ the strength of the concrete poured at optimal ambient temperature of 65° F. The ultimate strength of concrete begins to fall when poured at temperatures between 70° F. and 90° F., and at 100° F. there may be a 50% loss of strength. The problem of laying concrete at exceedingly high ambient temperature apparently relates to the evaporation rate of moisture from the concrete. If the moisture in the concrete evaporates at too high a rate, the curing process cannot be satisfactorily completed, resulting in a weakened concrete product. In order to contain the moisture within the concrete to allow for an optimal curing process, it is frequently necessary to cover the concrete in order to prevent moisture evaporation. In this case, a simple plastic sheeting may be overlaid on the concrete to serve as a moisture barrier and to thereby retard moisture evaporation from the concrete.

There is a need for a technique and apparatus to better control the curing properties of concrete in adverse ambient temperatures. The present invention meets this need by permitting an operator to control the temperature range during the concrete pouring process and thereby controlling the curing rate and curing temperature.

SUMMARY OF THE INVENTION

The method of the present invention involves laying a grid of plastic hose segments across the area to be overlaid with concrete and connecting the respective end points of the plastic hose segments to liquid manifolds and then connecting the manifolds to a delivery and return hose which is coupled to a temperature controller and pump. The volume and temperature of the heated or cooled liquid delivered by the temperature controller and pump are controlled to provide a curing temperature for the fresh concrete which is overlaid over the entire parallel plastic tubular segments. After the curing has been completed, the manifolds are removed and the plastic tubing segments are left in place.

The apparatus of the present invention includes the above-described manifolds and plastic tubing segments, as well as the temperature controller and pump apparatus and other suitable pressure valves to assist in the delivery of a controlled volume of liquid at a controlled temperature. Preferably, a plastic sheet is used to cover the concrete during the curing process.

It is preferable that the liquid used in the system is an antifreeze solution of water which is diluted sufficiently to prevent freezing of the liquid during the concrete curing operation.

A feature and advantage of the present invention is the utilization of inexpensive plastic tubing for forming the network of tubes within the curing concrete volume.

It is a principal object of the present invention to provide an inexpensive network of plastic tubing for assisting in the curing of concrete which network need not be removed from the finished, cured concrete volume.

BRIEF DESCRIPTION OF THE DRAWINGS

The objects and advantages of the present invention will become apparent from the following specification and claims and with reference to the appended drawings.

DESCRIPTION OF THE PREFERRED EMBODIMENT

Figure 1:
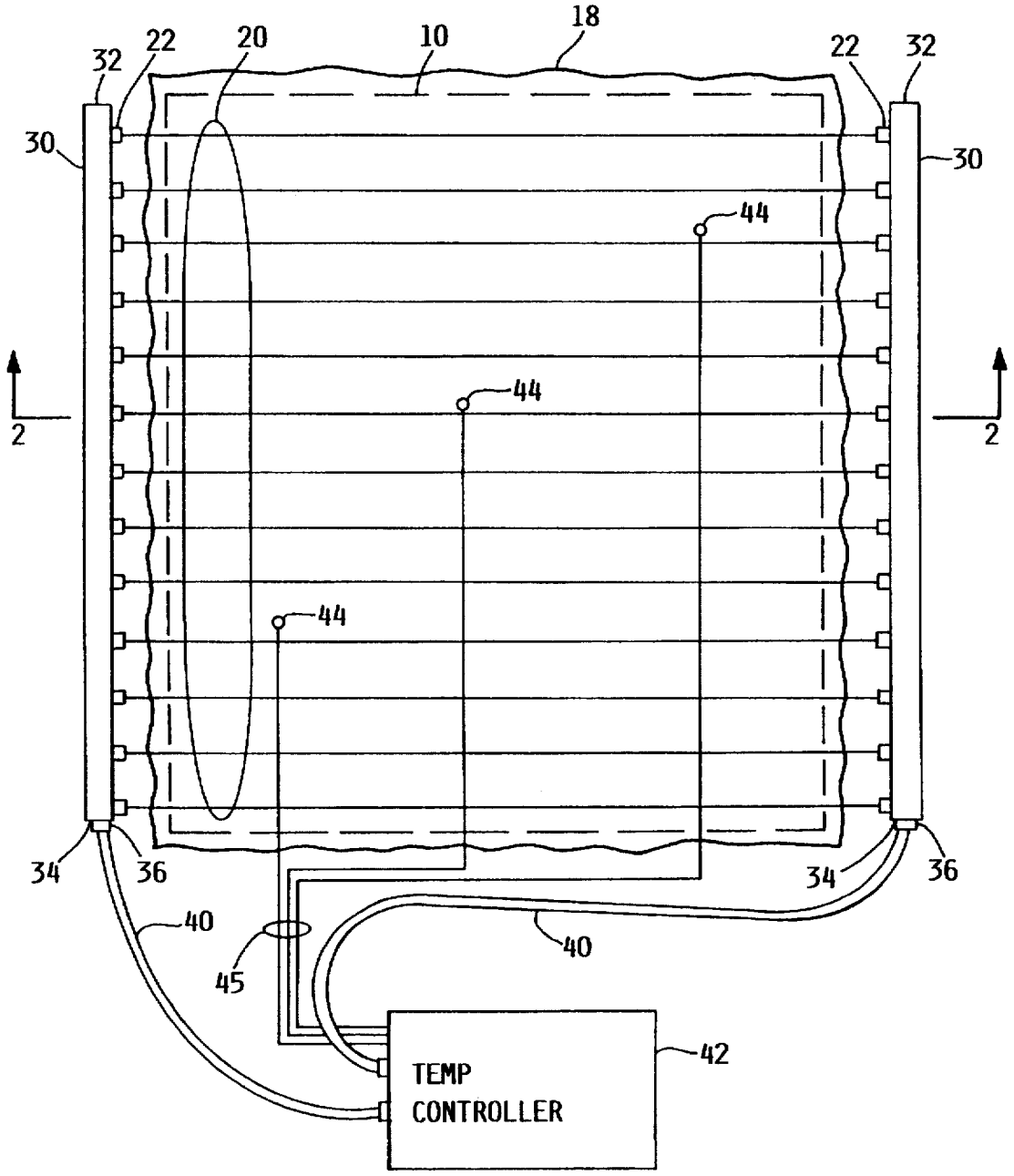
FIG. 1 shows a top plan view of the invention installed for curing concrete over a relatively large area.

Referring first to FIG. 1, there is shown a top plan view of the invention installed in a layout for curing concrete poured over a large flat surface. It is apparent that the teachings of the invention could be equally applied to concrete poured in other forms; for example, concrete poured to form a footing or foundation for a building. The poured concrete is shown by the dotted outline 10, which would typically be confined by suitable forms or edging boards. Before pouring the concrete into the area designated as 10, a plurality of plastic hoses or tubes 20 are laid over the area in spaced-apart relationship, preferably at one to two foot spacings. Plastic tubes 20 may be ⅜ to ⅝-inch tubing of relatively inexpensive polyethylene construction. The tubes 20 may be overlaid atop the metal reinforcing mesh which is usually used to strengthen the concrete, or they may be laid beneath the metal reinforcing mesh. It is important that the tubes 20 be positioned so as to become well immersed into the concrete after it is poured.

Each of the tubes 20 has its respective ends connected via fittings 22 to manifolds 30. Manifolds 30 may be formed from 2-inch plastic pipe, with the fittings 22 threaded or otherwise affixed via a plurality of spaced-apart openings through the side walls of the respective manifolds 30. One end 32 of each of the manifolds 30 is sealed to prevent leakage, and the other end 34 is adapted to accept a fitting 36. Each of the fittings 36 is connected to a hose 40, which preferably is about ⅝ to ¾-inch in diameter. Both of the hoses 40 are connected to a temperature controller 42, which includes a boiler and pump. The boiler and pump apparatus is constructed according to conventional techniques, typically including a gas heater to heat the liquid in the boiler and a liquid pump to circulate the liquid through the hoses, manifolds and plastic tubes.

The temperature controller 42 may also include a liquid cooler to lower the liquid temperature under high ambient temperature conditions, although it has been found that the ambient temperature of any typical water supply is sufficiently cool to serve as a cooling liquid without further cooling being necessary. In such cases, it is usually only necessary to shut off the heater associated with the boiler and to circulate unheated liquid through the system. Of course, it is understood that the controls for operating the liquid pump and heating the liquid in the boiler may also be manually manipulated by suitable valves and control switches (not shown) which may be positioned near the boiler and pump.

One or more temperature sensors 44 may be placed into the concrete area and connected via the wires 45 into the temperature controller 42. In a typical installation, a single temperature sensor 44 may be sufficient, although several temperature sensors may be appropriate in very large concrete areas. After the concrete 10 has been poured, an insulation blanket 18 is overlaid atop the newly-poured concrete. Insulation blanket 18 may be made from plastic sheet, and primarily functions to control the rate of moisture evaporation from the concrete.

Figure 2:
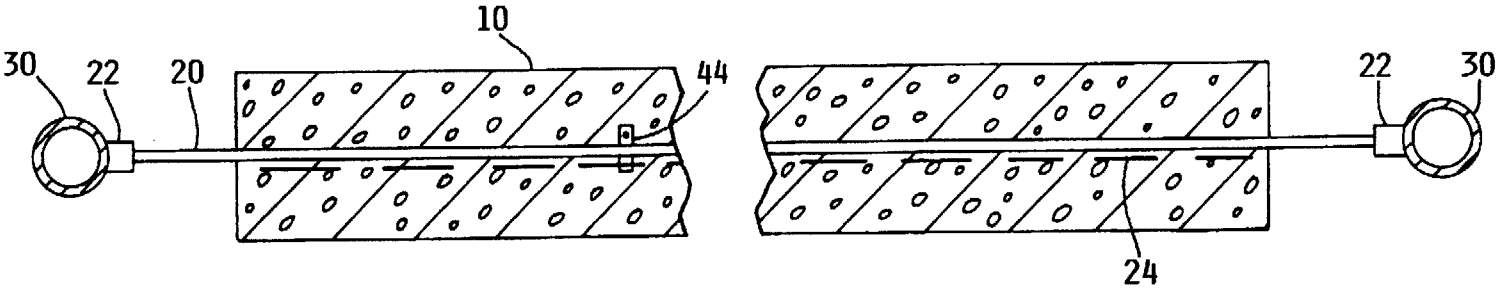
FIG. 2 shows a typical cross-section view of the apparatus of FIG. 1.

FIG. 2 shows a cross-section view of the apparatus of FIG. 1. The tubes 20 are positioned in the interior of the concrete 10, either above or below the wire reinforcing mesh 24. FIG. 2 shows the tubes 20 positioned above the wire mesh 24, and the temperature sensor 44 immersed into the concrete.

Figure 3:
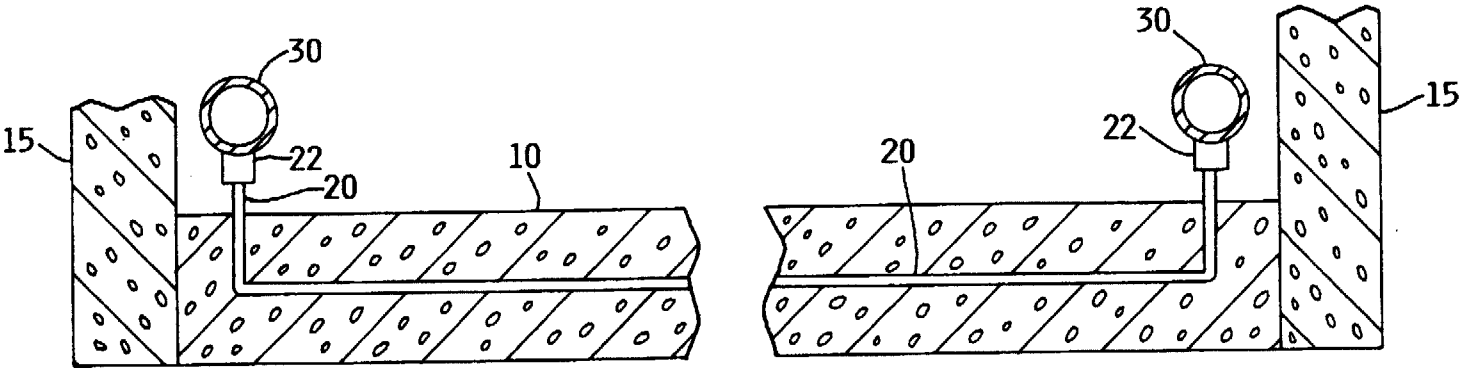
FIG. 3 shows a cross-section view of an alternative embodiment similar to that of FIG. 1.

FIG. 3 shows a cross-section view of an alternative construction, where the concrete 10 is poured over an area between two upstanding walls 15. In this construction, it is necessary to position the respective manifolds 30 above the concrete floor 10, by making a right angle bend in the respective tubes 20 to engage the fittings 22 and a manifold 30 above the surface of the concrete floor 10.

Figure 4:
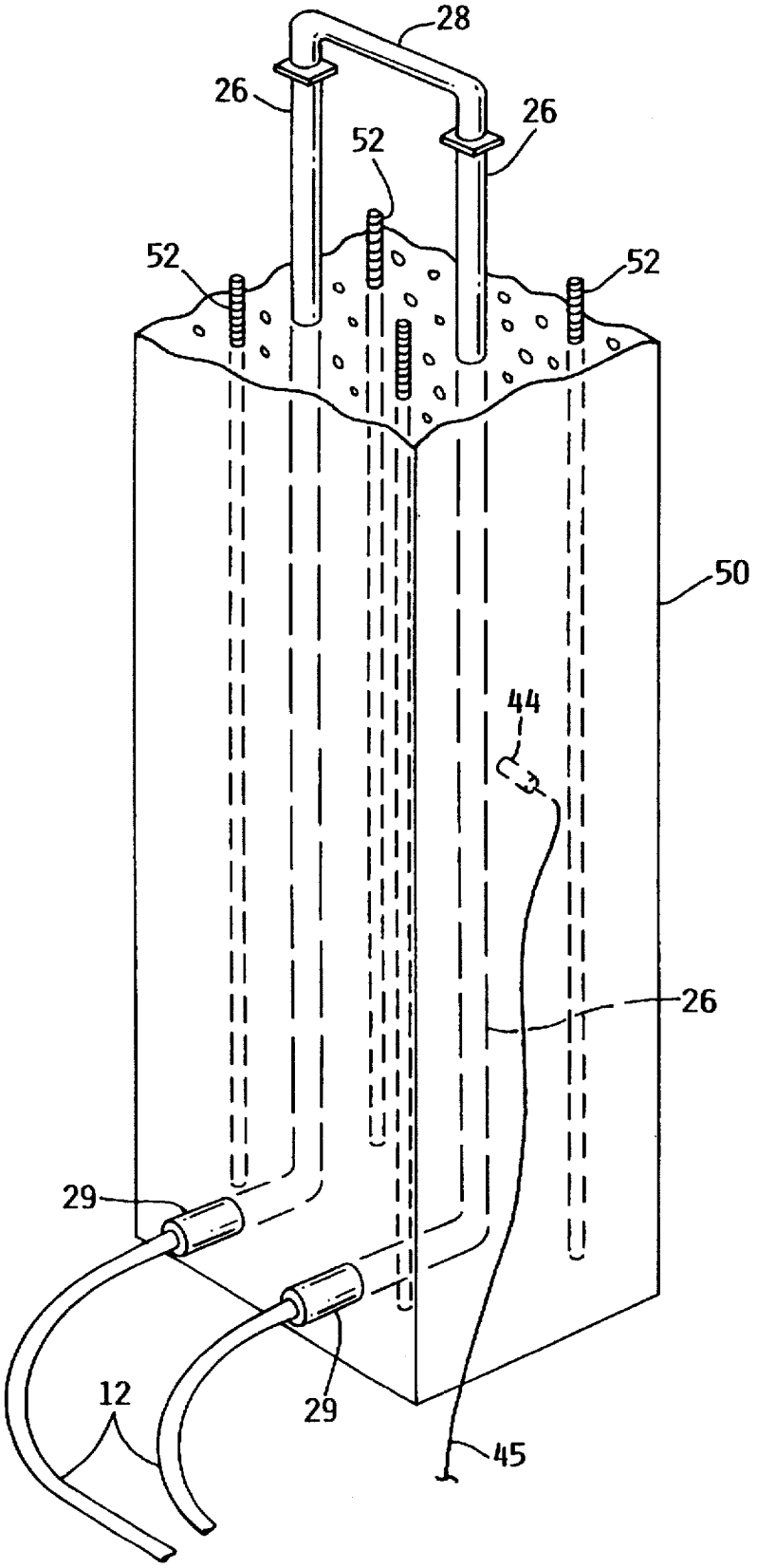
FIG. 4 shows an isometric view of the invention used in connection with curing concrete in a solid column.

FIG. 4 shows an isometric view of a vertical column 50 of poured concrete with the invention installed. The vertical column 50 is typically prepared for accepting poured concrete by first constructing a vertical form supported by panels, and then positioning a plurality of steel reinforcing rods at spaced-apart positions inside the vertical form. Two or more plastic tubes 26 are positioned inside the form as shown, and their respective ends are joined together by a manifold 28. The other ends of the plastic tubes are brought outside the form to connect to a second manifold (not shown) or to fittings 29 if only two tubes are used. Fittings 29 are attached to hoses 12, and hoses 12 are connected to a temperature controller as described earlier herein. A temperature sensor 44 may be positioned as shown.

Figure 5:
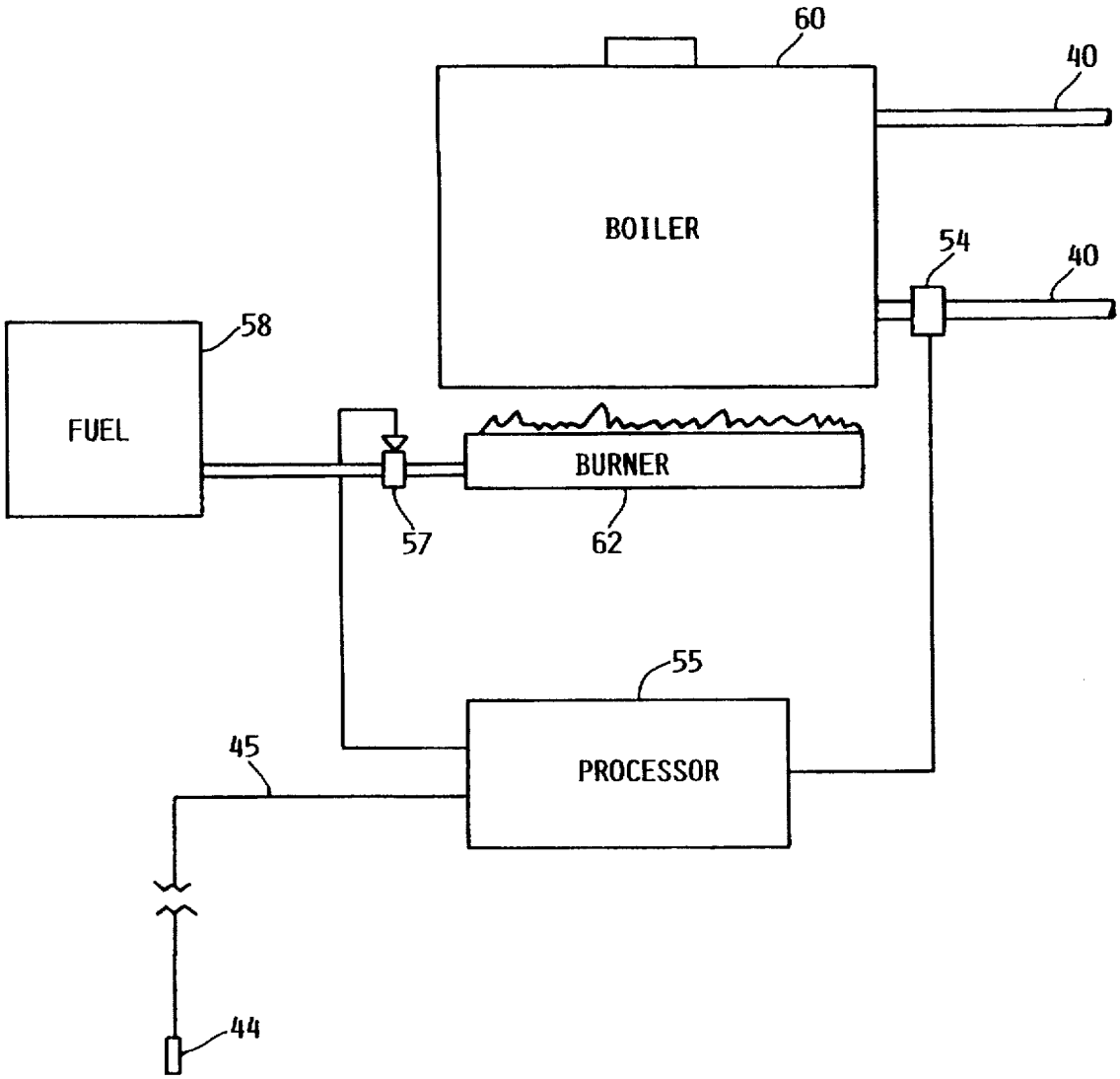
FIG. 5 shows a schematic diagram of the temperature control system.

FIG. 5 shows a schematic diagram of the temperature controller. A boiler 60 may be filled with liquid, preferably a mixture of water and antifreeze, and connected to the hoses 40. A pump 54 is connected into the liquid flow circuit, preferably at the outlet of the boiler 60. A burner 62 is positioned beneath the boiler and fuel is selectively fed to the burner 62 from a fuel tank 58, via fuel valve 57. One or more temperature sensors 44 are connected via wires 45 to a computer processor 55. All of the foregoing components are of conventional design and are commercially available. Processor 55 may be a properly programmed, general purpose personal computer, having suitable control circuit wiring to enable it to receive electrical signals from temperature sensors 44, and to transmit electrical signals to a valve 57 and a pump 54. In particular, processor 55 may be programmed to monitor the temperature of the interior volume of the curing concrete, and to control the temperature of the liquid in boiler 60 by turning the burner 62 on and off, and to control the flow of heated liquid through the tubes buried in the concrete by selectively controlling pump 54. In this manner, an optimum curing temperature may be selected, and the heating of the concrete controlled to maintain the optimum curing temperature over a period of many hours. In some cases, the optimum curing temperature may require cooling liquid to be pumped from the boiler 60; in such cases, the burner 62 would not be activated but the pump 54 would be activated.

Experimentation has shown that the heat of hydration of concrete as it cures can raise the internal temperatures of the concrete to upwards of 140° F. It is believed that concrete will achieve its maximum final strength if the heat of hydration develops temperatures in the range of about 100° F.–165° F. Of course, the hydration temperatures are significantly affected by the ambient temperature; and therefore, ambient temperature has some effect in determining the ultimate strength of the concrete. According to the present invention, the internal concrete temperature may be monitored during the curing process; and when combined with the aforementioned insulation blanket, the curing rate and temperature may be closely controlled by the system. It is desirable to program the computer processor so as to maintain the internal concrete temperature in the range of 100° F.–165° F., and this temperature range may be achieved by the processor selectively controlling the flow of heated and/or cooled liquid through the concrete during the curing process.

In operation, the forms for laying concrete are prepared as shown herein, with the plastic hoses or tubes positioned at suitable spaced-apart locations and respectively connected to manifolds. In general, the colder the ambient temperature, the closer the tube spacing should be, and the more tubes should be used. Likewise, the higher the ambient temperature, the closer the tube spacing should be, and the more tubes should be used. Under some circumstances it may be desirable to use liquid pressure regulators, either in the main hoses leading to the manifold or in the respective tubes. Such pressure regulators may be connected between any tube and a manifold, for instance.

In some cases, the plastic sheeting which covers the concrete during the curing process may be eliminated in favor of a liquid spray material of the type commonly known in the art. Such material has been used to spray on concrete during the curing process for it slows the evaporation process and functions to retain moisture to assist in proper curing of the concrete.

Depending on the ambient temperature, the temperature of the liquid in the system is either heated or cooled, and the liquid is circulated through the manifolds and tubes during and after the pouring of the concrete. Continued circulation of the liquid through the system for a number of hours after the concrete pouring operation has been completed will greatly speed up the curing process and will lead to an improved quality and strength of the finished product.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. A method of preparing properly cured concrete in a concrete form, comprising the steps of:

a. laying a plurality of tubes in said concrete form at spaced-apart distances, with the respective ends of each tube extending outside the concrete form;

b. connecting one end of each of said tubes to a first liquid manifold, and connecting the first liquid manifold to a source of liquid; and connecting the other end of each of said tubes to a second liquid manifold, and connecting the second liquid manifold to a return path to said source of liquid;

c. pouring uncured concrete into said concrete form and over said plurality of tubes in said concrete form;

d. adjusting the temperature of the liquid in said source of liquid to bring the temperature of the concrete to within the range of 50–80 degrees Fahrenheit; and e. flowing said liquid through said tubes, whereby to control the curing temperature of said concrete in said form.

2. The method of claim 1, further comprising the steps of continuing the flowing of said liquid until said concrete has hardened, and then ceasing the flowing of said liquid, and removing said first and second manifold from said tubes without removing said tubes from said concrete.

3. The method of claim 1, wherein the step of laying a plurality of tubes further comprises spacing said tubes at distances of from 12 to 24 inches.

4. A method for optimizing the curing of concrete poured into concrete forms, comprising the steps of:

a. laying a plurality of spaced-apart plastic tubes into said concrete forms prior to pouring said concrete, placing respective ends of said tubes outside said forms;

b. connecting the ends of said plurality of spaced-apart plastic tubes to a source of liquid and a liquid pumping system, whereby said liquid may be pumped through said tubes laying in said concrete forms;

c. pouring liquid concrete into said forms and immersing said tubes into said liquid concrete;

d. adjusting the temperature of said source of liquid, whereby the curing of said concrete may be optimized; and e. flowing said liquid through said tubes until said concrete hardens, and disconnecting the flow of said liquid through said tubes, and disconnecting said tubes from said source of liquid and said pumping system; whereby said tubes remain embedded in said hardened concrete.

5. The method of claim 4, wherein said plurality of plastic tubes further comprise polyethylene plastic.

6. The method of claim 5, wherein said tubes are spaced-apart at distances ranging from 12 to 24 inches.

7. An apparatus for curing concrete poured into forms, comprising:

a. a reservoir for retaining a supply of liquid, and a pumping system connected to said reservoir for placing said liquid under a predetermined pressure;

b. a temperature control system connected to said reservoir for controlling the temperature of liquid in said reservoir and delivered by said pumping system;

c. a plurality of hose segments laid into said concrete forms at spaced-apart positions, the respective ends of said hose segments positioned outside said forms; and d. a first liquid manifold connected to one set of the respective ends of said hoses, and a second liquid manifold connected to a second set of the respective ends of said hoses, one of said manifolds further connected as a return to said liquid reservoir, and the other of said manifolds further connected to said pumping system.

8. The apparatus of claim 7, wherein the temperature control system further comprises at least one temperature sensor embedded in said concrete, and a computer processor connected to said temperature sensor and to said pumping system; said computer processor having means for monitoring the temperature indicated by said at least one temperature sensor, and means for controllably actuating said pumping system to maintain the monitored temperature within a predetermined range.

9. The apparatus of claim 7, wherein the temperature control system further comprises a manually operable valve connected to said reservoir, and a manually operable switch connected to said pumping system.

10. The apparatus of claim 8, further comprising a liquid moisture barrier spray applied to the surface of said concrete.

11. The apparatus of claim 8, further comprising an insulation blanket covering said concrete.

12. The apparatus of claim 8, wherein said predetermined range of temperatures further comprises 100° F. to 165° F.

13. The apparatus of claim 11, wherein said insulation blanket further comprises a plastic sheet.

14. The apparatus of claim 7, wherein said hose segments further comprise polyethylene tubes.

15. The apparatus of claim 14, wherein said tubes are each between ⅜ inch and ⅝ inch in diameter.

16. The apparatus of claim 14, wherein said liquid further comprises a mixture of antifreeze and water.

* * * * *